US005864147A

United States Patent [19]

Konuma

[11] Patent Number: 5,864,147

[45] Date of Patent: Jan. 26, 1999

[54] FIELD EMISSION DEVICE HAVING CONFIGURATION FOR CORRECTING DEVIATION OF ELECTRON EMISSION DIRECTION

[75] Inventor: Kazuo Konuma, Tokyo, Japan

[73] Assignee: NEC Corporation, Tokyo, Japan

[21] Appl. No.: 881,363

[22] Filed: Jun. 24, 1997

[30] Foreign Application Priority Data

Jun. 24, 1996 [JP] Japan ..... 8-163501

[51] Int. Cl.[6] ..... H01J 1/02

[52] U.S. Cl. ..... 257/10; 257/11; 313/308; 313/309; 313/336; 313/351; 313/495; 313/496; 313/497

[58] Field of Search ..... 313/308, 309, 313/336, 351, 495–497; 257/10, 11

[56] References Cited

U.S. PATENT DOCUMENTS

| | | | |
|---|---|---|---|
| 4,574,216 | 3/1986 | Hoeberechts et al. | 257/10 |
| 5,396,150 | 3/1995 | Wu et al. | 313/309 |
| 5,581,146 | 12/1996 | Pribat et al. | 313/309 |

FOREIGN PATENT DOCUMENTS 4284324 10/1992 European Pat. Off. .

OTHER PUBLICATIONS

Journal of Applied Physics, vol. 47, No. 2, pp. 5248–5263, "Physical Properties of thin–film field emission cathodes with molybdenum cones", C.A. Spindt, published Dec. 1996.

IEEE Journal, IEDM 86, pp. 776–779, "A Vacuum Field Effect Transistor using Silicon Field Emitter Arrays", H.F. Gray, G.J. Campisi and R.F. Greene.

*Primary Examiner*—Tom Thomas
*Assistant Examiner*—Fetsum Abraham
*Attorney, Agent, or Firm*—Sughrue, Mion, Zinn, Macpeak & Seas, PLLC

[57] ABSTRACT

A field emission device is configured so as to suppress any deviation of the central axis of the distribution of emitted electrons from a conical cathode, with no electrode in addition to the gate electrode. A conductive layer is disposed over an insulating layer and has an electron emission window disposed over the conical cathode. Plural curved slits are formed in the conductive layer so as to expose the insulating layer and are arranged along a circle which is concentric with the tip of the conical cathode. The gate electrode is formed by the portion of conductive layer between the electron emission window and the curved slits. The portion of the conductive layer outside of the curved slits serves to distribute an applied potential to the gate electrodes of plural field emission devices arranged in a matrix. The portions of the conductive layer disposed between the curved slits serve to connect the gate electrode to the outer portion of the conductive layer. By selection of the physical geometry of the gate electrode, the field emission window, and the curved slits, and/or by selection of the relative doping concentrations of the gate electrode and the portions of the conductive layer disposed between the curved slits, any deviation in the emission direction of the electrons is automatically compensated for by a deviation in the voltage dropped by a portion of the gate electrode into which a disproportionate amount of electrons have been emitted.

18 Claims, 7 Drawing Sheets

FIELD EMISSION DEVICE HAVING CONFIGURATION FOR CORRECTING DEVIATION OF ELECTRON EMISSION DIRECTION

BACKGROUND OF THE INVENTION

1. Field of the Invention

The present invention relates to a field emission device and more particularly, to a field emission device capable of automatic compensation of the distribution deviation of emitted electrons from a cathode.

2. Description of the Prior Art

Conventionally, various types of field emission devices have been developed, typical examples of which were reported by C. A. Spindt et al. in the paper, Journal of Applied Physics, Vol. 47, No. 12, pp. 5248–5263, published in December 1976, and by H. F. Gray et al. in the paper, 1986 IEDM Technical Digest, pp. 776–779, published in 1986.

An example of the conventional field emission devices is shown in FIG. 1, which includes a semiconductor substrate 131. An insulating layer 132 is formed on the substrate 131. A conductive layer 133 is formed on the insulating layer 132. The conductive layer 133 serves as a gate electrode and has circular windows 134 uncovering the surface of the underlying insulating layer 132. The windows 134 are arranged in a matrix array. The insulating layer 132 has penetrating circular holes (not shown) formed at the locations corresponding to the windows 134, respectively, thereby exposing the surface of the substrate 131.

Conical cathodes 135, which are made of a conductive metal such as molybdenum (Mo), are formed on the exposed surface of the substrate 131 in the holes of the insulating layer 132, respectively. Each of the cathodes 135 has a shape of a sharp-pointed cone. The tips of the cathodes 135 are located in the vicinity of the interface of the gate electrode 133 and the insulating layer 132.

When a positive electric potential is applied to the gate electrode 133 with respect to the conical cathodes 135 in a vacuum atmosphere, electrons (not shown) are emitted or extracted from the vicinity of the tips of the cathodes 135 due to the "field emission" phenomenon. The emitted electrons move upward in the space near the gate electrode 133, traveling toward an anode (not shown).

The condition for the field emission phenomenon of the electrons is determined according to the shape of the cathodes 135 and the distances between the gate electrode 133 and the corresponding cathodes 135.

With the conventional field emission device shown in FIG. 1, the overall emission direction of the electrons is dependent upon (a) the electric-field distribution in the vicinity of the tips of the conical cathodes 135, (b) the surface state (for example, the work function and electron density) of the cathodes 135 in the vicinity of their tips, and (c) the surface configuration (for example, surface irregularities) of the cathodes 135 in the vicinity of their tips.

If the shape of each cathode 135 is accurately conical, the surface state and configuration of the cathode 135 are axially symmetric with respect to its central axis penetrating the tip, and the distance of the cathode 135 from the opposing inner edge of the gate electrode 133 is axially symmetric with respect to the central axis, the emitted electrons will travel from the tip through a conical region with a solid angle of approximately 40°.

However, if the above-described axial symmetry of either the shape, or the surface state, or and the surface configuration is collapsed, the central or symmetric axis of the distribution of the emitted electrons will deviate from its original position. This symmetric-axis deviation causes a problem that aberration tends to occur in the case where the emitted electrons are collected by an electron lens or lenses (not shown) or that deviation of the overall emission direction of the electrons from an intended direction tends to occur even for the case where no electron lens is used.

Further, the above symmetric-axis deviation causes another problem that the emitted electrons tend to stream into or enter the gate electrode 133, thereby consuming surplus electric power. This surplus power consumption heats the neighboring regions of the gate electrode 133 with the cathodes 135 to generate some gaseous material. The generated gaseous material leads to the insulation breakdown phenomenon. Therefore, a "discharge current" tends to flow between the gate electrode 133 and the cathodes 135, destroying or damaging the gate 133 and/or the cathodes 135.

At this stage, a part of the emitted electrons tend to directly or indirectly enter the insulating layer 132, thereby charging-up the insulating layer 132. Thus, there arises a problem that the insulating characteristic of the field emission device degrades. In other words, a leakage current tends to flow between the gate electrode 133 and the substrate 131. This results in an unstable potential difference between the gate electrode 133 and the substrate 131 (i.e., the cathodes 135).

A typical example of the above-described destruction of the gate electrode 133 and/or the cathodes 135 due to the discharge current is the short-circuit-induced destruction, where the gate electrode 133 and at least one of the cathodes 135 are electrically connected to be destroyed due to short-circuit.

To solve the problem of the short-circuit-induced destruction, the following improvement was developed as disclosed in the Japanese Non-Examined Patent Publication no. 4-284324 published in 1992.

In this improvement, a gate electrode is divided into a plurality of electrode elements; an unsoluble main element and soluble branch elements located at respective cathodes. When short-circuit occurs between the gate electrode and any one of the cathodes, the corresponding one of the branch elements of the gate electrode is solved or melted by heat due to the short-circuit, thereby being separated from the remainder. Thus, the normal operation of the remaining cathodes is surely kept even after the short-circuit.

However, the improvement disclosed in the Japanese Non-Examined Patent Publication no. 4-284324 cannot solve the previously-explained problem caused by the deviation of the symmetric axis of the emitted electron distribution.

SUMMARY OF THE INVENTION

Accordingly, an object of the present invention is to provide a field emission device that suppresses deviation of the symmetric or central axis of the distribution of emitted electrons from a cathode without using an additional electrode.

Another object of the present invention is to provide a field emission device that suppresses the unwanted streaming or entering of the emitted electrons into a gate electrode.

Still another object of the present invention is to provide a field emission device that can automatically compensate the symmetric-axis deviation of the emitted electron distribution.

The above objects together with others not specifically mentioned will become clear to those skilled in the art from the following description.

A field emission device according to the present invention is comprised of a substrate with a main surface, an insulating layer formed on the main surface of the substrate, and a conductive layer selectively formed on the insulating layer.

The insulating layer has a hole to uncover the underlying main surface of the substrate.

A cathode is formed on the uncovered main surface of the substrate in the hole of the insulating layer. The cathode has a conical shape the bottom of which is connected to the main surface of the substrate and the tip of which is directed toward an opposite side to the substrate.

The conductive layer has a first window for electron emission and a second window for uncovering the insulating layer. The first window is formed to be overlapped with the opening of the insulating layer, allowing emitted electrons from the cathode to penetrate the conductive layer. The second window is formed to surround the first window.

A first part of the conductive layer, which is located between the first and second windows, serves as a gate electrode. A second part of the conductive layer, which is located outside the second window, serves as a conductor to which an electric potential is applied. A third part of the conductive layer, which is formed to bridge the second window, serves to electrically connect the second part to the first part.

Electrons are emitted from the tip of the cathode to travel through the first window of the conductive layer on application of a voltage across the conductive layer and the substrate.

The symmetrical axis of the distribution of the emitted electrons is automatically compensated for by a deviation in a voltage drop developed in the first part of the conductive layer due to entering of the emitted electrons into the gate electrode.

With the field emission device according to the present invention, the conductive layer has the first window for electron emission and the second window for uncovering the insulating layer. The first window is formed to be overlapped with the opening of the insulating layer, allowing emitted electrons from the cathode to penetrate the conductive layer. The second window is formed to surround the first window.

The first part of the conductive layer, which is located between the first and second windows, serves as a gate electrode. The second part of the conductive layer, which is located outside the second window, serves as the conductor to which an electric potential is applied. The third part of the conductive layer, which is formed to penetrate the second window, serves to electrically connect the second part to the first part.

Therefore, if some of the emitted electrons enter the first part of the conductive layer serving as the gate electrode at a location in the distribution of the emitted electrons, a voltage drop occurs in the first part of the conductive layer. This voltage drop decreases the voltage (or, electric potential difference) between the cathode and the gate electrode, thereby reducing the number of emitted electrons in the location.

Accordingly, the symmetrical axis of the distribution of the emitted electrons is automatically compensated for deviation by the voltage drop occurred in the first part of the conductive layer due to entering of the emitted electrons.

As a result, the deviation of the symmetric axis of the distribution of emitted electrons is suppressed without using an additional electrode. This means that the unwanted streaming or entering of the emitted electrons into the gate electrode is suppressed.

In a preferred embodiment of the field emission device according to the invention, the second window is formed by slits arranged at an interval along a circle concentric with the tip of the cathode. There is an additional advantage that the voltage drop is effectively generated in the first part of the conductive layer without increasing the area of the first part of the conductive layer.

In another preferred embodiment of the field emission device according to the invention, the second window has a portion expanded radially and outward to adjust the electric field in the vicinity of the expanded portion. There is an additional advantage that the emitted electrons are designed to enter the first part of the conductive layer in any other radial directions than that of the expanded portion.

In this case, it is preferred that the expanded portion is located in a radial direction adjacent the third part of the conductive layer. There is an additional advantage that the voltage drop is effectively generated in the first part of the conductive layer.

In still another preferred embodiment of the field emission device according to the invention, the first window has a portion expanded radially and outward to adjust the electric field in the vicinity of the expanded portion. There is an additional advantage that the emitted electrons are designed to enter the first part of the conductive layer in any other radial directions than that of the expanded portion.

In this case, it is preferred that the expanded portion is located in a radial direction adjacent the third part of the conductive layer. There is an additional advantage that the voltage drop is effectively generated in the first part of the conductive layer.

BRIEF DESCRIPTION OF THE DRAWINGS

In order that the invention may be readily carried into effect, it will now be described with reference to the accompanying drawings.

DETAILED DESCRIPTION OF THE PREFERRED EMBODIMENTS

Figure 1:
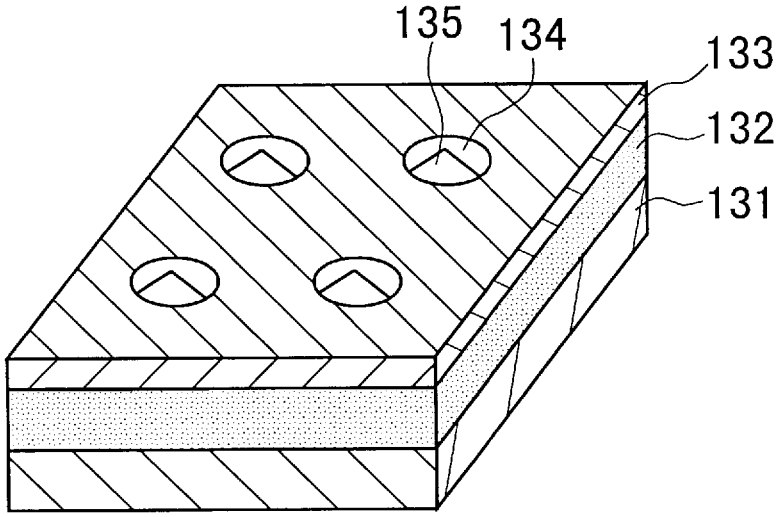
FIG. 1 PRIOR ART
Fig. 1 is a schematic cross sectional view of a conventional field emission device.

Preferred embodiments of the present invention will be described below referring to the drawings attached.

FIRST EMBODIMENT

Similar to the conventional field emission device shown in FIG. 1, a field emission device according to a first embodiment of the present invention has a plurality of same cathodes regularly arranged on a semiconductor substrate. However, only one of the plurality of cathodes is described here for the sake of simplification of description.

Figure 2:
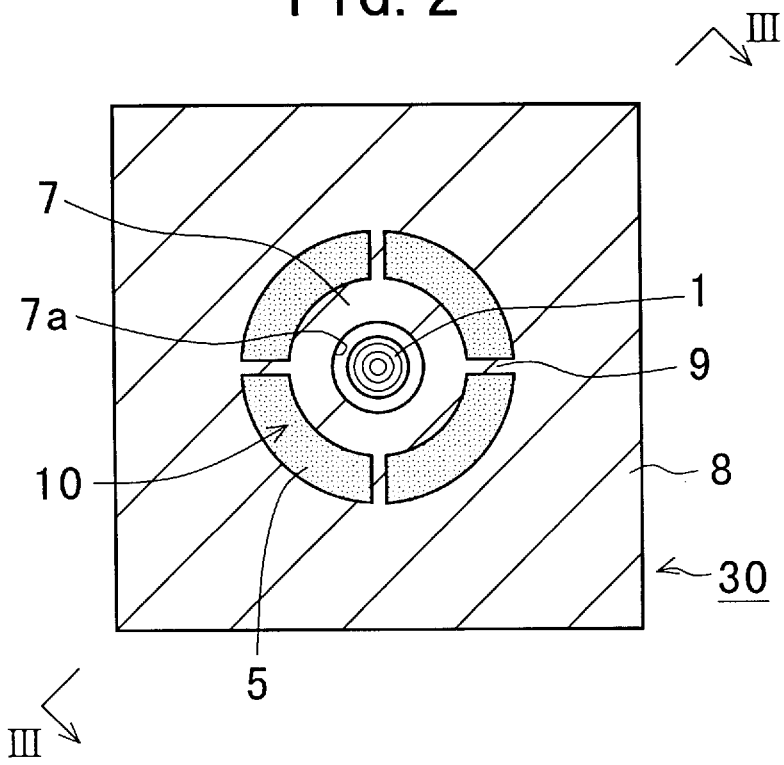
FIG. 2 is a schematic, partial plan view of a field emission device according to a first embodiment of the present invention.
Figure 3:
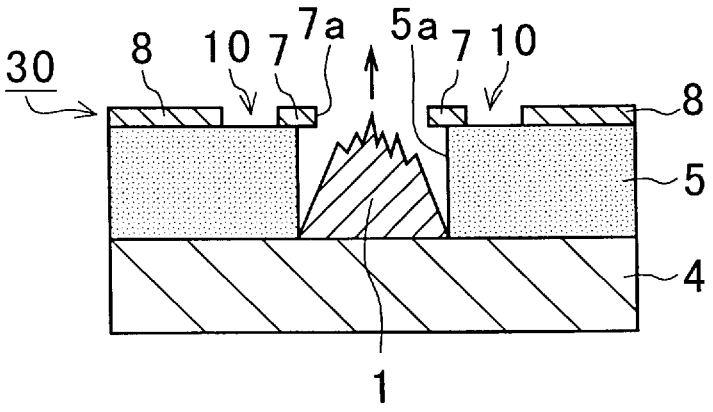
FIG. 3 is a schematic cross sectional view along the line III—III in FIG. 2.

As shown in FIGS. 2 and 3, a field emission device according to a first embodiment includes a semiconductor substrate 4 having a main surface, an insulating layer 5 formed on the main surface of the substrate 4, and a conductive layer 30 formed on the insulating layer 5.

The insulating layer 5, which is made of, for example, a $SiO_2$, has a circular penetrating hole 5*a* to uncover the underlying main surface of the substrate 4.

A cathode 1, which is made of a conductive metal such as Mo, is formed on the exposed main surface of the substrate 4 in the hole 5*a* of the insulating layer 5. The cathode 1 has a shape of a sharp-pointed cone the bottom of which is connected to the upper main surface of the substrate 4 and the tip of which is directed upward. The tip of the cathode 1 is located in the vicinity of the interface of the conductive layer 30 and the insulating layer 5.

The conductive layer 30, which is made of a conductive metal such as tungsten (W), has a circular window 7*a* concentric with the hole 5*a* of the insulating layer 5 and the conical cathode 1. The window 7*a* has a smaller diameter than that of the hole 5*a* (i.e., the bottom of the cathode 1). The window 7*a* is formed to overhang the hole 5*a* and therefore, the window 7*a* is completely overlapped with the underlying hole 5*a*.

The conductive layer 30 further has four curved slits or windows 10 to uncover the underlying surface of the insulating layer 5. The slits 10 are located on a circle with a larger diameter than that of the window 7*a* and the hole 5*a*. Each of the four slits 10 is approximately equal to a part obtained by quadrisecting a circular hoop or tape having a constant width.

By the four curved slits or windows 10, the conductive layer 30 is divided into a circular-ringed inner part 7, four strip-shaped middle parts 9, and a remaining outer part 8. The inner part 7 is mechanically and electrically connected to the outer part 8 through the middle parts 9.

The inner part 7 serves as a gate electrode. The remaining outer part 8 serves as a conductor for applying an electric potential (i.e., a gate voltage) to the gate electrode 7 and for electrically connecting the gate electrode 7 to other gate electrodes (not shown). The middle part 9 serves as an interconnection for electrically connecting the outer part 8 to the inner part 7.

The inner edge of the gate electrode or inner part 7 has a smaller diameter than that of the hole 5*a* of the insulating layer 5. The outer edges of the gate electrode or inner part 7, which are inner edges of the outer part 8, have a larger diameter than that of the hole 5*a* of the insulating layer 5. In other words, the gate electrode 7 is partially overlapped with the hole 5*a*.

Figure 4:
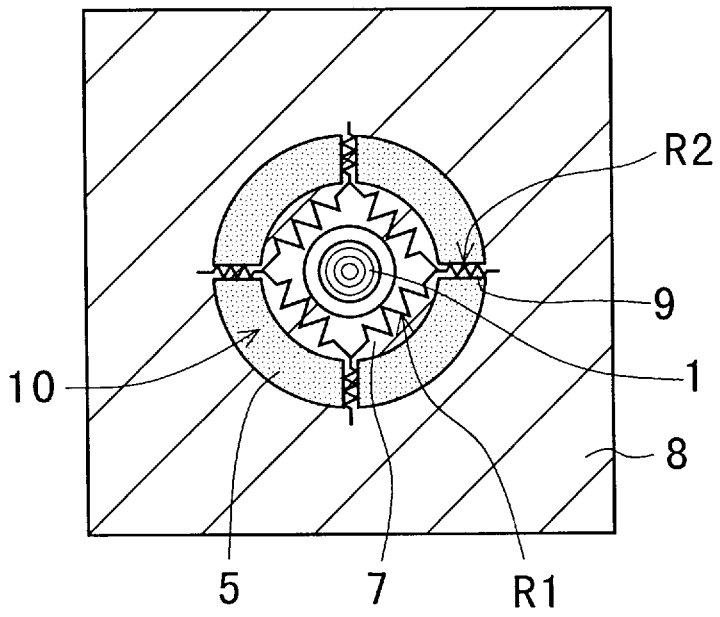
FIG. 4 is a schematic, partial plan view of the field emission device according to the first embodiment, as shown in FIG. 2, which an equivalent circuit diagram is superimposed.

As shown in FIG. 4, the diameter of the gate electrode 7 is determined in such a way that the region of the gate electrode 7 between the neighboring two middle parts 9 has a resistance R1, which is greater than a resistance R2 of each of the corresponding middle parts 9.

With the field emission device according to the first embodiment, when a voltage is applied across the cathode 1 (i.e., substrate 4) and the conductive layer 30 in such a way that a positive potential is applied to the conductive layer 30, electrons are emitted from the vicinity of the tip of the cathode 1 to travel upward through the windows 7*a* of the gate electrode 7 due to the field emission phenomenon.

If a part of the emitted electrons enter a location of the gate electrode 7, the electrons flow out through the gate electrode 7 (i.e., the inner part 7 of the conductive layer 30), the middle part 9 of the layer 30, and the remaining outer part 8 of the layer 30, resulting in a voltage drop. This means that the electric potential at the electron-entered location is lower than that of the remaining gate electrode 7. The value of the voltage drop varies dependent upon not only the current path (i.e., the distance from the entered location to the nearest middle part 9) but also the number of entered electrons.

If the resistance of the gate electrode 7 is sufficiently greater than that of the middle part 9, it can be said that the above voltage drop occurs in the electrode 7 only. At the same time, the potential of the middle part 9 is substantially kept at the potential of the conductor layer 30 itself. Although the voltage drop occurs in the remaining inner region 7 other than the electron entry location, the remaining inner region 7 has a higher potential than that of the electron entry location, which is substantially equal to the potential of the conductive layer 30.

Thus, the potential at the electron entry location in the inner region 7 automatically decreases according to the length of the current path and the number of the entered electrons. Consequently, the deviation of the symmetric or central axis of the distribution of the emitted electrons can be suppressed so as to automatically compensate the symmetric-axis deviation of the emitted electron distribution.

In other words, the unwanted streaming or flowing of the emitted electrons into the gate electrode 7 can be automatically and immediately compensated.

As a result, the deviation of the symmetric axis of the distribution of emitted electrons is suppressed without using an additional electrode. This means that the unwanted streaming or entering of the emitted electrons into the gate electrode is suppressed.

In the first embodiment, to ensure the resistance between the adjoining two ones of the middle parts 9 through the gate electrode 7 sufficiently higher than the resistance of each middle part 9 itself, it is preferred that the outer diameter of the gate electrode 7 is possibly small to decrease the length of the part 9.

For example, a single-crystal silicon (Si) substrate with a square plan shape may be used as the substrate 4. A silicon dioxide ($SiO_2$) layer with a thickness of 1 $\mu$m may be used as the insulating layer 5. A polycrystalline tungsten (W) layer with a thickness of 200 nm may be used as the conductive layer 30. The bottom diameter of the cathode 1 may be 1 $\mu$m. The inner part 7 (i.e., gate electrode) of the conductive layer 30 may have an inner diameter of 1 $\mu$m and an outer diameter of 1.2 $\mu$m. Each of the middle parts 9 of the conductive layer 30 may have a radial length of 0.1 $\mu$m and a circumferential width of 0.2 $\mu$m. The resistance of the gate electrode 7 may be approximately 5 kΩ/μm. The resistance of the middle parts 9 may be approximately 250 Ω/μm.

SECOND EMBODIMENT

Figure 5:
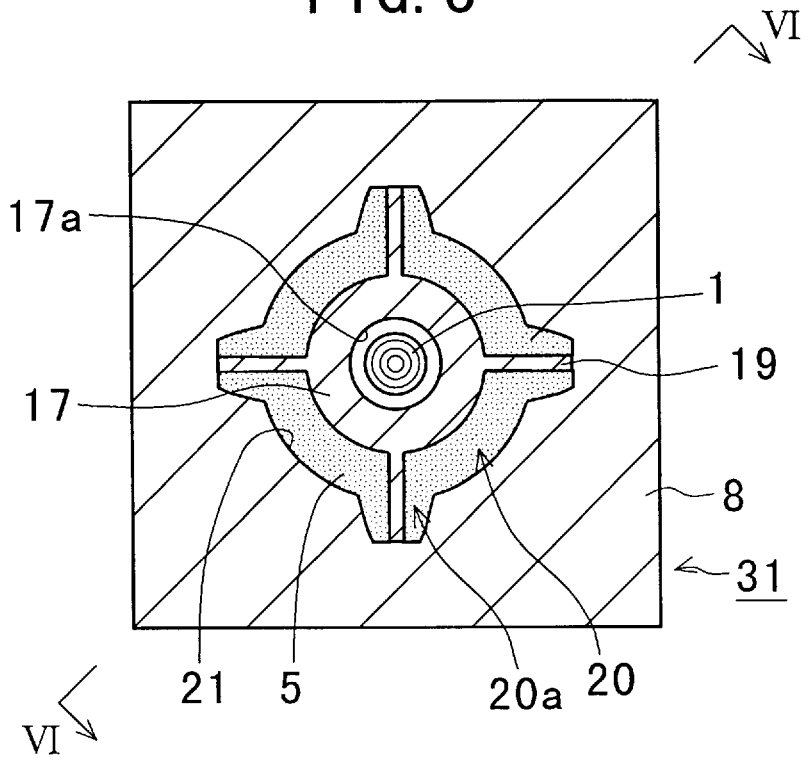
FIG. 5 is a schematic, partial plan view of a field emission device according to a second embodiment of the present invention.
Figure 6:
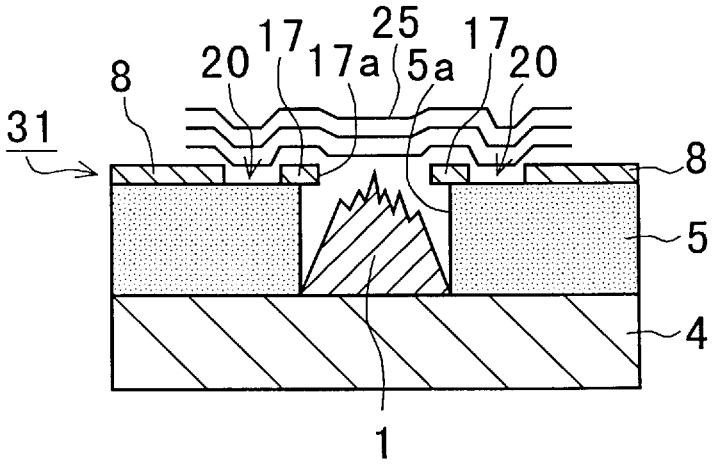
FIG. 6 is a schematic cross sectional view along the line VI—VI in FIG. 5.

A field emission device according to a second embodiment is shown in FIGS. 5 and 6, which is the same in configuration as that according to the first embodiment, except for the shape of slits 20. Therefore, by adding the same reference characters to the corresponding elements in FIGS. 5 and 6, the description relating to the same configuration is omitted here for the sake of simplification of description.

In the device according to the second embodiment, as shown in FIGS. 5 and 6, each of the slits 20 has two protruding or expanding regions 20*a* located at each end near the respective middle parts 19. The regions 20*a* expand or protrude radially outward. Therefore, the inner edges 21 of the outer part 8 are radially expanded in the vicinity of the respective middle parts 19.

The regions 20*a* serve to decrease the electric-field strength in the vicinity of the respective middle parts 19 compared with the device according to the first embodiment. Preferably, the regions 20*a* have a same width as that of the parts 19 or wider. The reason is that if the regions 20*a* have are excessively narrow, desired electric-field relaxation cannot be realized.

It is preferred that the width and length of the middle parts 19 are designed in such a way that the electric-field strength near the parts 19 and the voltage drop occurring in the gate electrode 17 are well balanced.

The reference numeral 25 in FIG. 6 indicates equipotential planes in the vicinity of the gate electrode 17, where the electric potential is lower in the location over the slits 20 than in the conductive layer 31 other, than the slits 20. Therefore, the electric field is lower inside the slits 20 than outside the slits 20.

Figure 7:
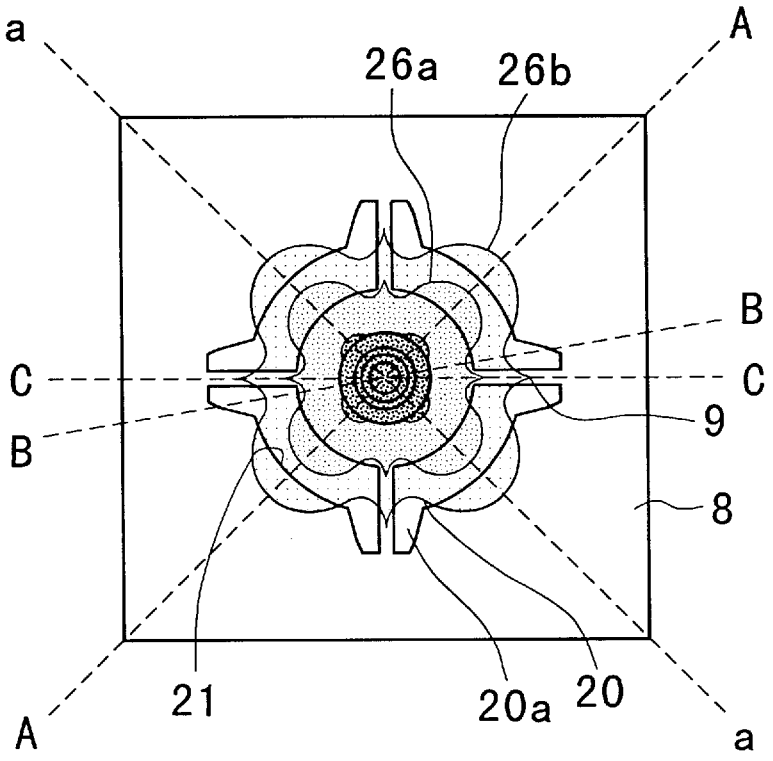
FIG. 7 is a schematic, partial plan view of the field emission device according to the second embodiment, as shown in FIG. 5, which the two-dimensional electric-field distribution is superimposed.

FIG. 7 shows the two-dimensional electric-field distribution on the surface of the insulating layer 5 in the field emission device according to the second embodiment. In FIG. 7, the hatching concentration is proportional to the electric-field strength.

Figure 8:
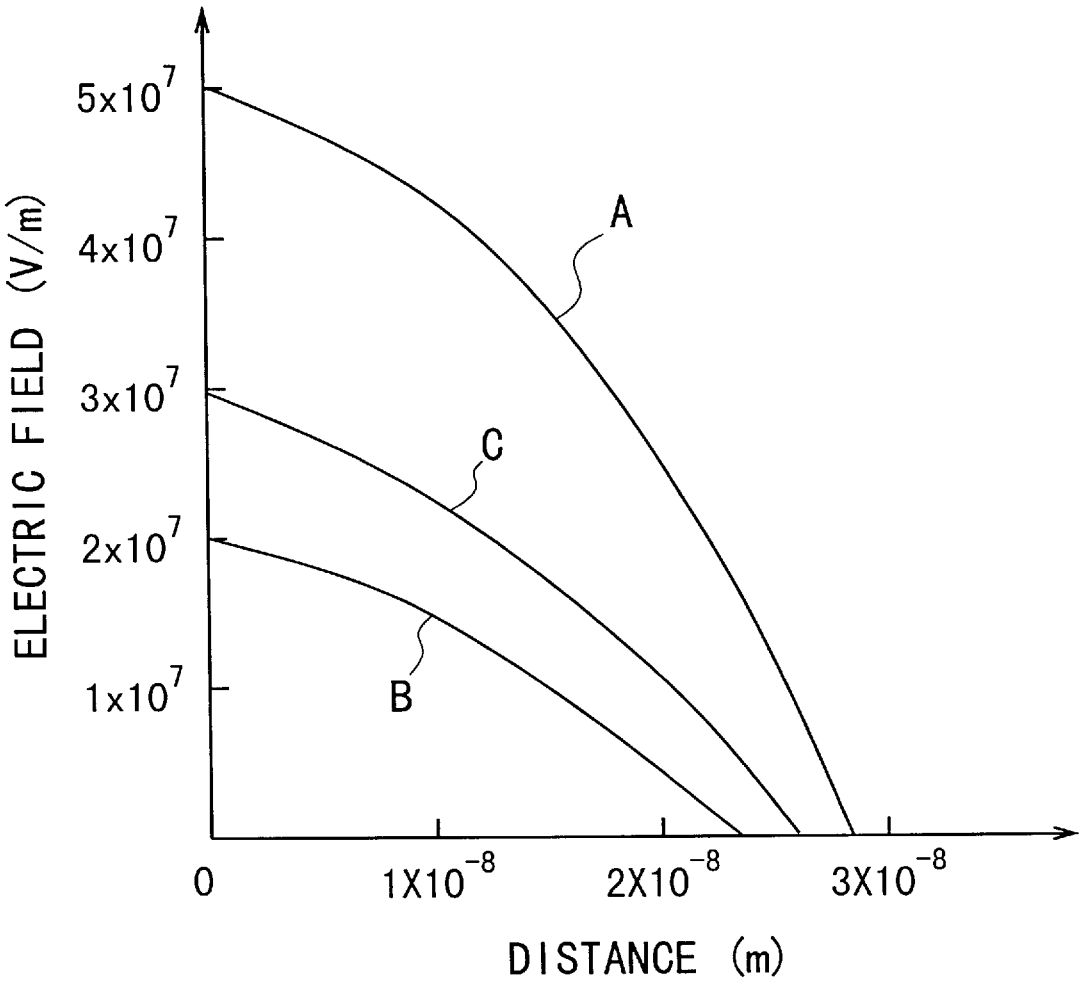
FIG. 8 is a graph showing the relationship between the electric field and the distance from the tip of the cathode in the field emission device according to the second embodiment.

FIG. 8 shows the relationship between the electric field and the distance from the tip of the cathode 1 in the field emission device according to the second embodiment.

As seen from FIGS. 7 and 8, in a direction along a diagonal line A—A, where the line A—A does not intersect the protrusion parts 20*a* of the windows or slits 20, the electric field expands over a very wide area and the electric-field strength is the strongest in the direction A—A. If the surface state and condition of the cathode 1 are axial symmetry, the number of the electrons to be emitted in the direction A—A is the most. Therefore, the number of the electrons to be emitted from the cathode along the direction A—A is the same as that of a diagonal direction a—a, because of the sane configuration. This may be applied to any other two equivalent directions.

In a direction along a line B—B, where the line B—B partially intersects the expanded parts 20*a* of the slits 20, the electric-field strength is lower than that in the direction B—B. This is because the electric-field strength is lowered or relaxed by the comparatively wide slits 20. This may be applied to any other three equivalent directions.

Therefore, the number of the electrons to be emitted from the cathode 1 along the direction B—B is smaller than that of the diagonal directions, a—a, because the same configuration.

In a direction along a line C—C, where the line C—C does not intersects the protrusion parts 20*a* of the gate-electrode slits 20 and intersects the middle part 19, the electric-field strength is the lowest in the direction C—C. The electric-field distribution is complex and narrow, as seen from FIG. 7. Therefore, the number of the electrons to be emitted from the cathode 1 along the direction C—C is smaller than that of the diagonal directions such as A—A and a—a. This is due to the existence of the protrusion regions 20*a* and the boundary conditions. This may be applied to any other directions than that C—C.

Figure 9:
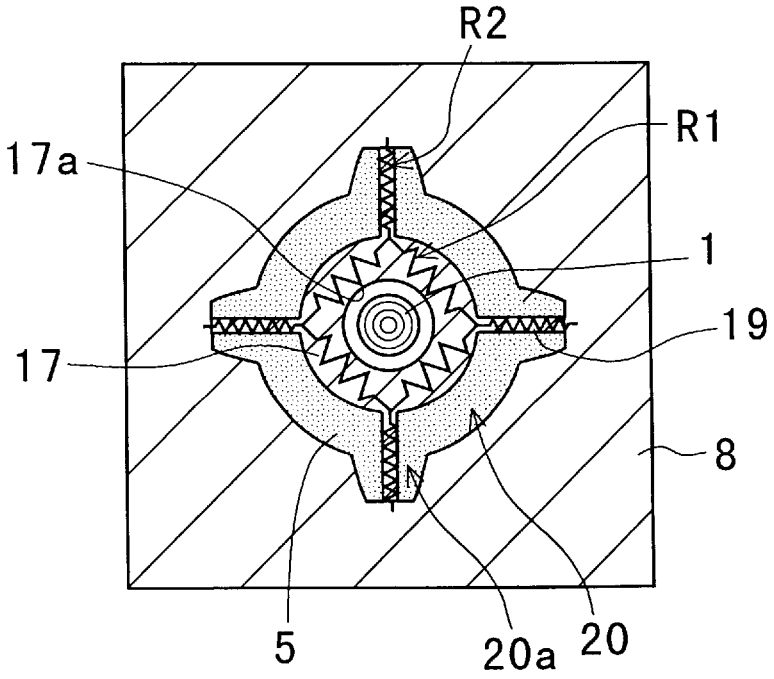
FIG. 9 is a schematic, partial plan view of the field emission device according to the second embodiment, as shown in FIG. 5 which an equivalent circuit diagram is superimposed.

As shown in FIG. 9, the diameter of the gate electrode 17 is determined in such a way that the region of the gate electrode 17 between the neighboring two middle parts 19 has a resistance R1, which is greater than a resistance R2 of each of the corresponding middle parts 9.

With the field emission device according to the second embodiment, there are the same advantages as those in the first embodiment. Further, the outer part 8 of the conductive layer 31 is made of low-resistance, conductive metal such as W, and the middle and inner parts 9 and 7 are made of high-resistance polysilicon. Therefore, there is an additional advantage that a large voltage drop is readily generated in the parts 9 and 7, resulting in effective, automatic compensation for the deviation of the central axis of the distribution of the emitted electrons.

Practically, the distribution of the emitted electrons is determined by the tendency along the diagonal directions such as A—A and the tendency due to the asymmetry in emission conditions. It may be supposed in the second embodiment that the electrons entering the gate electrode 17 will concentrate in the diagonal directions, in which the automatic compensation for the central-axis deviation of the electron distribution is effectively performed.

To differ the resistivity of the polysilicon middle parts 9 from the inner parts (i.e., the gate electrodes) 7, the dopant concentration into the polysilicon middle parts 9 may be increased compared with that of the inner parts 7.

In the second embodiment, considering the structural symmetry, the shape, number, and arrangement of the individual elements are designed symmetric with the rotational axis of the conical cathode 1. However, the third parts 19 need not be symmetrically arranged with respect to the rotational axis in the present invention, because such asymmetry can be compensated by properly adjusting the shape or pattern of the expanded regions 20*a*.

THIRD EMBODIMENT

Figure 10:
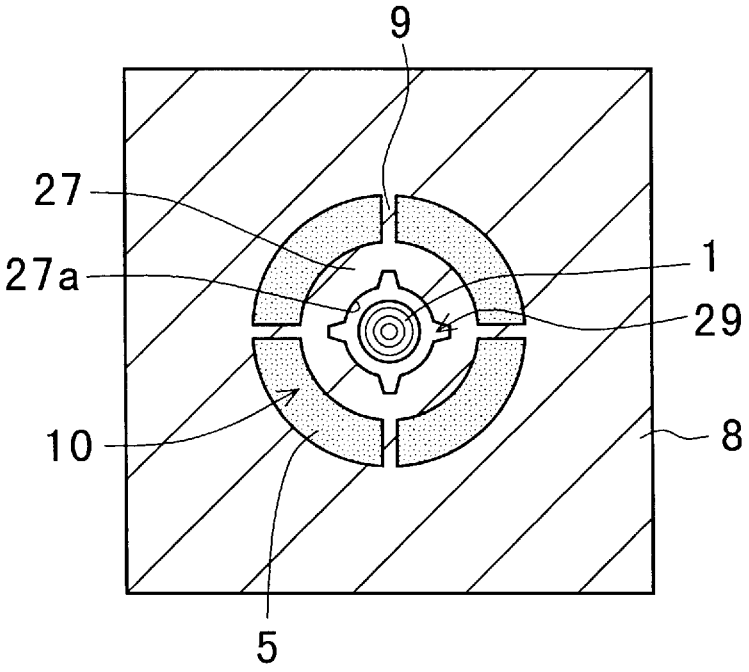
FIG. 10 is a schematic, partial plan view of a field emission device according to a third embodiment of the present invention.

A field emission device according to a third embodiment is shown in FIG. 10, which is the same in configuration as that according to the first embodiment, except that expansions or slits 29 are formed in a window 27*a* of a gate electrode 27. Therefore, by adding the same reference characters to the corresponding elements in FIG. 10, the description relating to the same configuration is omitted here.

In the device according to the third embodiment, as shown in FIG. 10, the inner edge 27*a* of the gate electrode 27 has four expansions 29 to increase the distance of the edge 27*a* from the cathode 1. The expansions 29 are located in the same directions as those for the middle parts 9 of the conductive layer 8.

Thus, the number of the emitted electrons and electric-field strength in the directions including the parts 9 are decreased compared with any other directions than those including the parts 9. Therefore, there are the same advantages as those in the first embodiment.

FABRICATION

A typical method of fabricating the field emission device according to the invention is as follows:

First, the insulating layer 5 is deposited on the surface of the substrate 4 and then, the conductive layer 30 is deposited on the insulating layer 5 by popular deposition processes, respectively. The insulating layer 5 may be formed by a silicon dioxide ($SiO_2$) layer with a thickness of 1 $\mu$m. The conductive layer 30 may be formed by a tungsten (W) or doped or non-doped polysilicon layer with a thickness of 200 nm.

Next, a photoresist layer is formed by a coating process on the conductive layer 30 and is patterned by a photolithography process in such a way that the area of the photoresist layer corresponding to the slits 10 or 20 and the window 7*a* are selectively removed. Using this patterned photoresist layer as a mask, the conductive layer 30 is then etched selectively by a dry etching process.

Further, after covering the slits 10 or 20 by another resist layer, the insulating layer 5 is selectively overetched by a dry etching process, thereby forming the overhanging gate electrode 7 on the insulating layer 5. In this step, the etch rate is designed to be lower for the gate electrode 7 and the substrate 4 than the insulating layer 5.

After removing the resist layer, a sacrificial layer, which may be an alumina ($Al_2O_3$) layer with a thickness of approximately 1 $\mu$m, is formed on the conductive layer 30 by a tilted evaporation process. During this process, the sacrificial layer is not formed in the window 7*a* of the conductive layer 7 and hole 5*a* of the insulating layer 5.

Subsequently, Mo is deposited on the sacrificial layer to form the conical cathode 1 on the substrate 4 in the opening 5*a*. Finally, the sacrificial layer is removed together with the Mo layer deposited thereon. Thus, the conical cathode 1 formed by the remaining Mo layer is selectively formed in the opening 5*a*.

In the above first to third embodiments, four middle parts 9 are provided. However, it is needless to say that the invention is not limited to these embodiments and that any other modification may be taken in the present invention.

While the preferred forms of the present invention has been described, it is to be understood that modifications will be apparent to those skilled in the art without departing from the spirit of the invention. The scope of the invention, therefore, is to be determined solely by the following claims.

What is claimed is:

1. A field emission device comprising:

a substrate with a main surface;

an insulating layer formed on the main surface of said substrate and having an opening formed therein to uncover the underlying main surface of said substrate;

a conductive layer selectively formed on said insulating layer so as to have a first window for electron emission and a second window uncovering said insulating layer, said first window being formed so as to overlap said opening of said insulating layer, and said second window being formed so as to surround said first window; and a cathode formed on the uncovered main surface of said substrate in said opening of said insulating layer and having a conical shape with a bottom and a tip, the bottom being connected to the main surface of said substrate and the tip being directed away from said substrate;

wherein said conductive layer has a first part, a second part, and a third part, said first Part of said conductive layer being a gate electrode disposed between the first and second windows, said second part of said conductive layer being disposed outside the second window and being a conductor to which an electric potential is applied, and said third part of said conductive layer being disposed across the second window so as to electrically connect the second part of said conductive layer to the first part of said conductive layer; and wherein electrons are emitted from the tip of said cathode to travel through the first window of said conductive layer when a voltage is applied across said conductive layer and said substrate; and wherein the electrons being emitted from the tip of said cathode have a symmetrical axis of distribution which is automatically compensated for deviation by a voltage drop developed in said first part of said conductive layer as a result of entry of a portion of the emitted electrons into said conductive layer.

2. The device as claimed in claim 1, wherein said second window is formed by slits arranged intervally along a circle concentric with the tip of said cathode.

3. The device as claimed in claim 1, wherein the second window has one or more expanded portions which are expanded radially outward so as to adjust an electric field in the vicinity of the one or more expanded portions.

4. The device as claimed in claim 3, wherein the one or more expanded portions are disposed adjacent said third part of the conductive layer.

5. The device as claimed in claim 1, wherein the first window has one or more expanded portions which are expanded radially outward so as to adjust an electric field in the vicinity of the one or more expanded portions.

6. The device as claimed in claim 5, wherein the one or more expanded portions are disposed adjacent said third part of the conductive layer.

7. A field emission device comprising:

a substrate with a main surface;

an insulating layer formed on the main surface of said substrate having an opening formed therein to uncover the underlying main surface of said substrate;

a conical cathode disposed in said opening of said insulating layer, being connected to the main surface of said substrate, and having a tip; and a conductive layer formed on said insulating layer so as to have an electron emission window overlapping said opening of said insulating layer, and having plural arcuate slits which expose the underlying insulating layer and are disposed so as to substantially coincide with a circle concentric with said tip;

wherein said conductive layer comprises:

a gate electrode disposed between said electron emission window and said plural arcuate slits, an outer portion disposed radially outward from said plural arcuate slits and being a conductor to which an electric potential is applied, and plural resistive portions, each one of said plural resistive portions being disposed between adjacent ones of said plurality of arcuate slits so as to electrically connect said gate electrode to said outer portion.

8. The device as claimed in claim 7, wherein each of said arcuate slits has an expanded portion at which the slit boundary is expanded radially outward with respect to said tip.

9. The device as claimed in claim 8, wherein the expanded portion of each of said arcuate slits is disposed adjacent one of said plural resistive portions.

10. The device as claimed in claim 7, wherein said electron emission window has plural expanded portions where the window boundary is expanded radially outward with respect to said tip.

11. The device as claimed in claim 10, wherein the expanded portion of each of said arcuate slits is disposed adjacent one of said plural resistive portions.

12. The device as claimed in claim 7, wherein the gate electrode has an outer diameter such that R1>R2, where R1 corresponds to the electrical resistance of a portion of the gate electrode between points at which the gate electrode is connected to adjacent ones of said plural resistive portions and R2 corresponds to the electrical resistance of one of said plural resistive portions.

13. The device as claimed in claim 12, wherein the gate electrode has an outer diameter such that R1>R2.

14. The device as claimed in claim 7, wherein said outer portion of said conductive layer comprises a material selected from the group consisting of: a low-resistance metal, doped polysilicon, and un-doped polysilicon.

15. The device as claimed in claim 7, wherein said outer portion of said conductive layer comprises tungsten.

16. The device as claimed in claim 7, wherein said gate electrode and said plural resistive portions comprise high-resistance polysilicon.

17. The device as claimed in claim 16, wherein said high-resistance polysilicon is doped.

18. The device as claimed in claim 17, wherein the high-resistance polysilicon forming said plural resistive portions has a higher doping concentration than a doping concentration of the high-resistance polysilicon forming said gate electrode, such that R1>R2, where R1 corresponds to the electrical resistance of a portion of the gate electrode between points at which the gate electrode is connected to adjacent ones of said plural resistive portions and R2 corresponds to the electrical resistance of one of said plural resistive portions.

* * * * *

UNITED STATES PATENT AND TRADEMARK OFFICE

CERTIFICATE OF CORRECTION

PATENT NO. : 5,864,147

DATED : January 26, 1999

INVENTOR(S) : Kazuo KONUMA

It is certified that error appears in the above-identified patent and that said Letters Patent is hereby corrected as shown below:

On the title page, item[56]:

"FOREIGN PATENT DOCUMENTS" under "References Cited" (i.e., at part [56]), delete the citation "4284324 10/1992 European" and substitute therefor the citation -- JP A 4-284324 10/1992 Japan --.

Signed and Sealed this

Twenty-second Day of June, 1999

*Attest:*

Q. TODD DICKINSON

*Attesting Officer*

*Acting Commissioner of Patents and Trademarks*